US005218718A

United States Patent [19]

Chih

[11] Patent Number: 5,218,718

[45] Date of Patent: Jun. 15, 1993

[54] STREET HOCKEY GOALTENDER'S BLOCKER

[75] Inventor: Huang Y. Chih, Kaohsiung, Taiwan

[73] Assignee: Canstar Sports Group Inc., Ville Mont-Royal, Canada

[21] Appl. No.: 868,635

[22] Filed: Apr. 15, 1992

[51] Int. Cl.[5] ..... A41D 13/10

[52] U.S. Cl. ..... 2/16; 2/161 A

[58] Field of Search ..... 2/16, 18, 20, 161 A, 2/160, 159, 161 R, DIG. 6

[56] References Cited

U.S. PATENT DOCUMENTS

| | | | |
|---|---|---|---|
| 3,605,117 | 9/1971 | Lafina | 2/16 |
| 3,626,515 | 12/1971 | Murray | 2/16 |
| 4,700,404 | 10/1987 | Lesperance | 2/161 A |
| 4,787,376 | 11/1988 | Eisenberg | 2/161 A |
| 4,984,300 | 1/1991 | Cho | 2/16 |
| 5,107,544 | 4/1992 | Capatosto | 2/16 |

*Primary Examiner*—Clifford D. Crowder
*Assistant Examiner*—Amy Brooke Vanatta
*Attorney, Agent, or Firm*—R. Craig Armstrong

[57] ABSTRACT

A street hockey goalie's blocker is described, which permits the blocker to be used on either the left hand or the right hand. The blocker has a generally planar rectangular blocking pad having a blocking side and an inner side, as in the prior art. Also as in the prior art, a sleeve is provided on the inner side of the blocking pad, and it has an integral thumbguard extending therefrom. However, the sleeve is removably attached to the inner side of the pad, instead of being sewn thereto, and is reversible. Removing the sleeve, turning it over, and then reattaching it in effect changes the position of the thumbguard from one hand to the other. A thumb strap is provided, as in the prior art, but instead of being sewn to one side of the thumbguard, it can be positioned on either side of the thumbguard, to allow for the reversibility of the thumbguard. In the preferred embodiment, strips of VELCRO (trademark) fastening material are used to attach the sleeve to the pad. A retention strap is used to assist in holding the sleeve in place, once it has been positioned using the VELCRO strips.

13 Claims, 3 Drawing Sheets

STREET HOCKEY GOALTENDER'S BLOCKER

BACKGROUND OF THE INVENTION

1. Field of the Invention

This invention relates to blocker for use by a goaltender in street hockey.

2. Description of the Prior Art

Until fairly recently, blockers were only used in ice hockey. However, blockers for street hockey goaltenders ("goalies") are now known. These blockers are much lighter than ice hockey blockers, since instead of a hard puck, all that is being blocked is a much lighter and softer street hockey ball, or very commonly, a tennis ball. The blockers which are presently available have a generally planar rectangular blocking pad having a blocking side and an inner side. One version has a sleeve sewn to the inner side of the blocker, including a thumbguard which extends therefrom and has a fixed sewn strap for the goalie to insert his (or her) thumb, and a finger flap also sewn to the inner side, including a sewn finger strap for the goalie to insert his fingers. The blocker is controlled by virtue of the sleeve, the thumb strap, and the finger strap.

In the prior art, because the thumbguard is fixed in position, blockers are either for the left hand or for the right hand. Since a goalie wears a blocker on one hand only, the other hand being for a catching glove, the blockers are therefore supplied as being either for the left hand or for the right hand, rather than as a pair. This means that retailers must stock both left hand and right hand blockers, rather than being able to carry an inventory of only one type.

In street hockey, which is rarely organized, play tends to be very informal, and players tend to switch positions with great regularity. Thus in the course of normal play, it is very common for a number of different people to take the goalie position. Some persons prefer to wear the blocker on their left hand, and some on their right hand, regardless in many cases of whether or not they are right-handed or left-handed. If the only blocker available is for the left hand, and the goalie prefers to wear it on the right hand, there is an obvious problem. It is very frequent that a group of street hockey players will not have enough equipment to go around.

A need for a universal blocker, i.e. one which could be adapted for use on either the left hand or the right hand, was therefore recognized. Such a blocker would not only appeal to consumers, since it could be used by more people, but would also appeal to retailers, since they would only have to stock one version of the blocker, rather than separate left-hand and right-hand versions.

SUMMARY OF THE INVENTION

It is an object of the invention to provide an improved street hockey goalie's blocker, which would permit the blocker to be used on either the left hand or the right hand.

In the invention, the blocker has a generally planar rectangular blocking pad having a blocking side and an inner side, as in the prior art. Also as in the prior art, a sleeve is provided on the inner side of the blocking pad, and it has an integral thumbguard extending therefrom. However, the sleeve is removably attached to the inner side of the pad, instead of being sewn thereto, and is reversible. Removing the sleeve, turning it over, and then reattaching it in effect changes the position of the thumbguard from one hand to the other. A thumb strap is provided, as in the prior art, but instead of being sewn to one side of the thumbguard, it can be positioned on either side of the thumbguard, to allow for the reversibility of the thumbguard.

In the preferred embodiment, strips of hook and pile material, e.g. VELCRO (trademark), are used to attach the sleeve to the pad. A retention strap is used to hold the sleeve in place, once it has been positioned using the VELCRO strips, as will be described in greater detail below.

Further features of the invention will be described or will become apparent in the course of the following detailed description.

BRIEF DESCRIPTION OF THE DRAWINGS

In order that the invention may be more clearly understood, the preferred embodiment thereof will now be described in detail by way of example, with reference to the accompanying drawings, in which.

DETAILED DESCRIPTION OF THE PREFERRED EMBODIMENT

Figure 1:
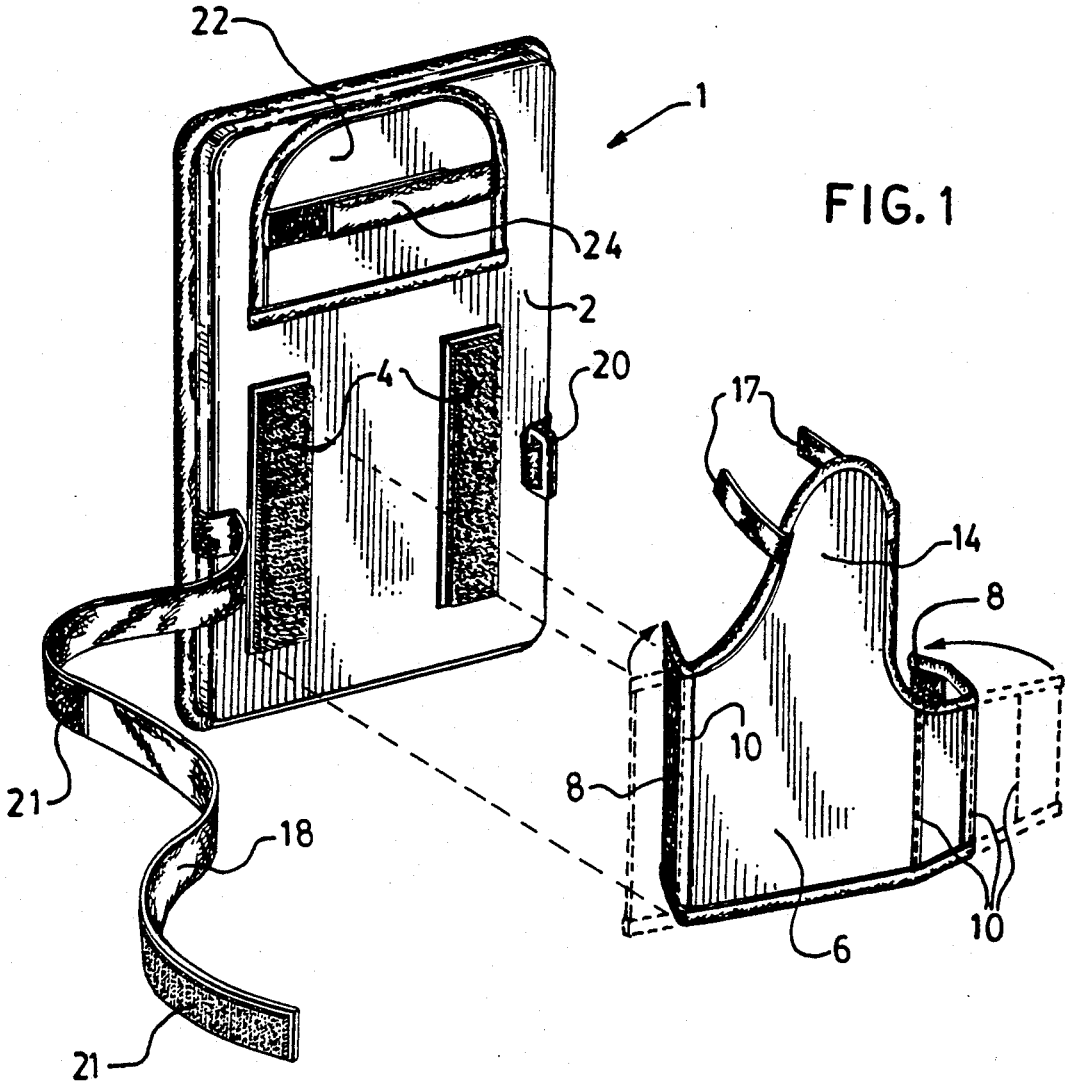
FIG. 1 is an exploded perspective view of the blocker of the present invention.
Figure 2:
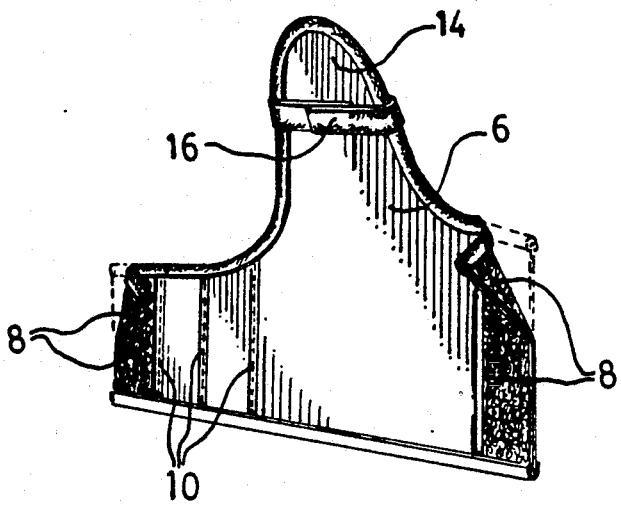
FIG. 2 is a perspective view of the reversible sleeve.
Figure 3:
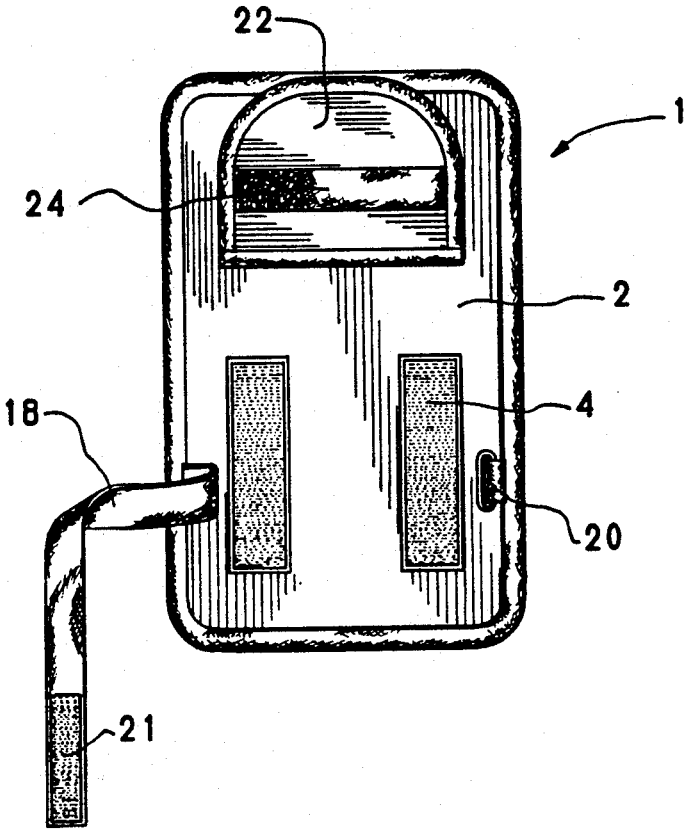
FIG. 3 is a view of inner side of the blocking pad of the blocker.

FIG. 1 is an exploded view showing the blocker 1, which includes a generally planar, rectangular blocking pad 2. On the inner side of the pad are two parallel strips 4 of VELCRO or other hook and pile material, spaced apart from each other, one towards each side of the blocker.

Figure 7:
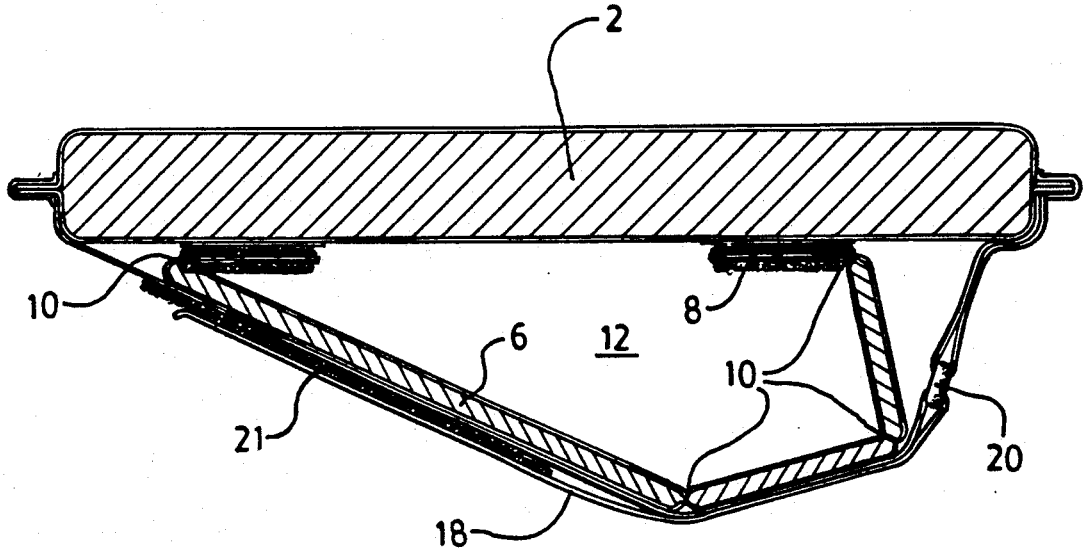
FIG. 7 is a cross-section of the blocker through the sleeve and the blocking pad.

A reversible padded sleeve 6 is provided, having VELCRO strips 8 corresponding to the strips 4 on the blocker aligned along opposite side edges thereof, on both and sides thereof to permit reversibility of the sleeve. Sewn lines 10 facilitate bending the sleeve as shown in FIG. 1, so that the VELCRO strips 8 can be mated with the VELCRO strips 4 to define a sleeve opening 12 for insertion of the goalie's hand, as best seen in FIG. 7.

An integral thumbguard 14 extends upwardly at an angle towards one side from approximately the middle of the top portion of the sleeve 6. The thumbguard is provided with a thumb strap 16. In use, the goalie slips his hand through the sleeve opening 12 and his thumb between the thumb strap 16 and the thumbguard 14. The thumbguard 14 is somewhat flexible relative to the blocking pad 2 so that the goalie can grasp his goalie stick.

Preferably, the strips 4 are of hook material, and the strips 8 are of pile material. Since only two of the strips 8 will be in engagement at any given time, it is preferable to have pile material exposed, rather than the scratchy hook material, which could irritate the goalie or catch on gloves or mitts.

Figure 4:
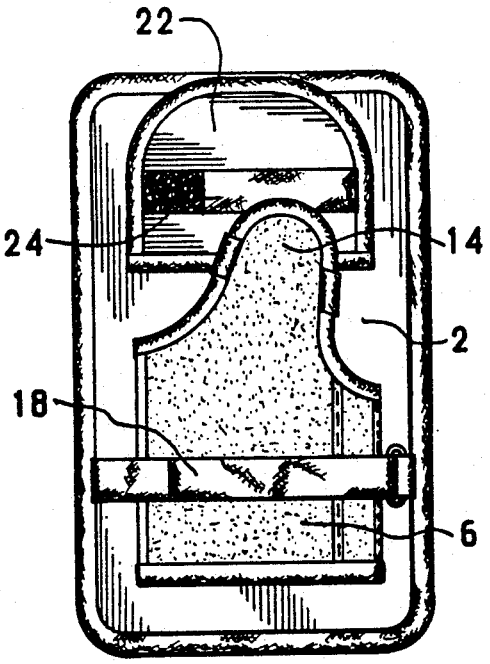
FIG. 4 is a view of inner side of the blocker with the sleeve positioned for use on the left hand.
Figure 5:
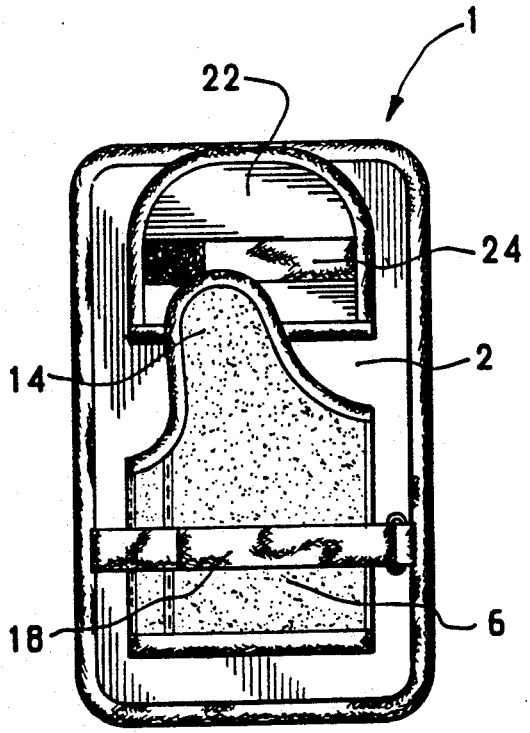
FIG. 5 is a view of inner side of the blocker with the sleeve positioned for use on the right hand.
Figure 6:
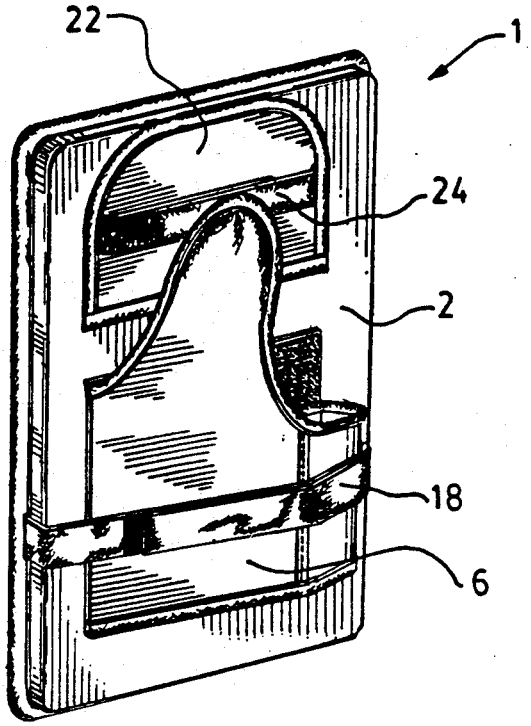
FIG. 6 is a perspective view of the blocker with the sleeve positioned for use on the left hand.

Since there are VELCRO strips 8 on both sides of the sleeve 6, it can be attached to the blocking pad 2 with the thumbguard 14 angling either to the right as shown in FIG. 4 or to the left as shown in FIG. 5, to accommodate either the left hand or the right hand respectively, depending on which side of the sleeve is secured to the blocking pad.

To provide reversibility, the thumb strap 16 can be positioned on either side of the thumbguard. Although this could be achieved in several ways, in the preferred embodiment the strap is formed from a pair of strap pieces 17 projecting one from each edge of the thumbguard, which can be routed to either side of the thumbguard and attached to each other to form the thumb strap This is most easily achieved by using mating pieces of VELCRO as the strap pieces This has the additional advantage of permitting the size of the thumb strap 16 to be easily varied.

Since the mated VELCRO strips 4 and 8 can only withstand limited outward force exerted thereon, a retention strap 18 preferably is used in conjunction with the VELCRO strips. It is positioned over the sleeve once the sleeve has been positioned using the VELCRO strips. In the preferred embodiment, the retention strap is sewn to one edge of the blocker, and is routed through a ring 20 sewn to the opposite edge of the blocker, and then folded back onto itself with VELCRO sections 21 serving to hold it in place.

A finger flap 22 is provided having a lower edge sewn to the blocking pad 2 and an upper edge free to flex outwardly therefrom. A finger strap 24 is provided, preferably formed from a pair of VELCRO strap pieces that can be mated and released The length of the finger strap 24 can be varied by changing the location where the straps are mated and thus the finger strap 24 allows for size adjustment.

In use, the goalie inserts his hand through the sleeve 12, thumb between the thumb strap 16 and thumbguard 14, and fingers between the flap 22 and the finger strap 24. The finger flap 22 serves as protection for the fingers.

It will be appreciated that the above description relates to the preferred embodiment by way of example only. Many variations on the invention will be obvious to those knowledgeable in the field.

For example, a strap having VELCRO thereon and a ring 20 could be used as an alternative to the pair of straps of thumb strap 16 or the pair of straps of finger strap 24. A belt and buckle could be substituted for retention strap 18 and ring 20, for thumb strap 16 or finger strap 24. Snap fasteners could be used as an alternative to VELCRO. An elastic strap having enough resilience to stretch over the top of the thumbguard 14 could be substituted for the thumb strap 16 or an elastic strap on the front and a second elastic strap on the back could be substituted for the thumb strap 16. Similarly an elastic strap could be substituted for the finger strap 24. Other like variations may be readily envisioned, without departing from the principle of the invention, and such variations are considered to be within the scope of the invention as defined in the following claims.

What is claimed as the invention is:

1. A street hockey goalie's blocker, comprising a generally planar rectangular blocking pad having a blocking side, an inner side, and top, bottom and opposite side edges, and a reversible sleeve releasably fastened to said inner side, said sleeve comprising a flexible panel having front and back sides, and having fastening means on both said front and back sides thereof near opposite side edges thereof for engaging complementary fastening means on said inner side of the blocking pad, said sleeve further comprising an integral thumbguard portion extending from a generally central upper region of the sleeve, angled away from an imaginary centerline running parallel to and approximately midway between said opposite side edges of said blocking pad, said sleeve being reversible such that said thumbguard angles in one direction from said imaginary centerline in one position, and in another direction from said imaginary centerline in the reversed position, depending on whether the fastening means on the front side of the sleeve is used, or the fastening means on the back side of the sleeve is used.

2. A blocker as recited in claim 1, in which said fastening means comprises complementary hook and pile fastening strips of two types, namely hook type and pile type, one said type of fastening strip being fastened along both front and back sides of said sleeve adjacent outer edges thereof, and the other said type of fastening strip being fastened in corresponding locations spaced apart laterally on the inner side of said blocker.

3. A blocker as recited in claim 2, where said fastening strips on the inner side of the blocker are of hook material, and said fastening strips on the sleeve are of pile material.

4. A blocker as recited in claim 2, said thumbguard further comprising a thumbstrap positionable on either side thereof.

5. A blocker as recited in claim 3, said thumbguard further comprising a thumbstrap positionable on either side thereof.

6. A blocker as recited in claim 2, further comprising a strap attached adjacent one edge of said blocker, passable across said sleeve to a location adjacent an opposite edge of said blocker, and means for securing said strap to assist in holding said sleeve in place.

7. A blocker as recited in claim 3, further comprising a strap attached adjacent one edge of said blocker, passable across said sleeve to a location adjacent an opposite edge of said blocker, and means for securing said strap to assist in holding said sleeve in place.

8. A blocker as recited in claim 4, further comprising a strap attached adjacent one edge of said blocker, passable across said sleeve to a location adjacent an opposite edge of said blocker, and means for securing said strap to assist in holding said sleeve in place.

9. A blocker as recited in claim 5, further comprising a strap attached adjacent one edge of said blocker, passable across said sleeve to a location adjacent an opposite edge of said blocker, and means for securing said strap to assist in holding said sleeve in place.

10. A blocker as recited in claim 4, in which said thumb strap comprises two strap portions at opposite edges of said thumbguard, adapted to be routed around either side of said thumbguard and fastenable to each other to define said thumb strap.

11. A blocker as recited in claim 5, in which said thumb strap comprises two strap portions at opposite edges of said thumbguard, adapted to be routed around either side of said thumbguard and fastenable to each other to define said thumb strap.

12. A blocker as recited in claim 1, said thumbguard further comprising a thumbstrap positionable on either side thereof.

13. A blocker as recited in claim 12, in which said thumb strap comprises two strap portions at opposite edges of said thumbguard, adapted to be routed around either side of said thumbguard and fastenable to each other to define said thumb strap.

* * * * *